United States Patent [19]

Niem et al.

[11] Patent Number: 4,582,010

[45] Date of Patent: Apr. 15, 1986

[54] UPPER FEED MECHANISM FOR SEWING MACHINES

[75] Inventors: Wolfgang Niem, Leonberg; Hermann Gauch, Moglingen, both of Fed. Rep. of Germany

[73] Assignee: Union Special GmbH, Stuttgart, Fed. Rep. of Germany

[21] Appl. No.: 714,227

[22] Filed: Mar. 21, 1985

[30] Foreign Application Priority Data

Apr. 14, 1984 [DE] Fed. Rep. of Germany ..... 3414219

[51] Int. Cl.[4] ..... D05B 27/06

[52] U.S. Cl. ..... 112/311; 112/320

[58] Field of Search ..... 112/320, 322, 311, 312, 112/314, 323, 324

[56] References Cited

U.S. PATENT DOCUMENTS 4,417,536 11/1983 Shiomi ..... 112/320 X 4,449,464 5/1984 Porter ..... 112/320 X 4,462,530 7/1984 Block et al. ..... 112/320 X

*Primary Examiner*—Werner H. Schroeder

*Assistant Examiner*—Andrew M. Falik

*Attorney, Agent, or Firm*—John A. Schaerli

[57] ABSTRACT

An upper feed mechanism positively driven in four directions above the work supporting surface of the machine for concommitantly advancing work along a predetermined feed path. The upper feed mechanism includes an upper feed dog carried on the presser arm of the machine. In the usual manner, the presser arm has a presser foot hinged at one end thereof. The opposite end of the presser arm is slidably pivoted relative the machine frame such that the presser arm, presser foot and upper feed dog mechanism may be conjointly moved sidewise as a modular assemblage thus permitting operating access to the sewing area of the machine.

17 Claims, 3 Drawing Figures

17
16
18
19
6
15
26
25
27
4
3
21
5
22
2

UPPER FEED MECHANISM FOR SEWING MACHINES

FIELD OF THE INVENTION

The present invention generally relates to sewing machines and, more particularly, to an upper feed mechanism for a sewing machine.

BACKGROUND OF THE INVENTION

Overedge sewing machines having top feed mechanism are known to those conversant in the sewing art and there are several U.S. Patents which illustrate and describe such machines. For detailed description of such a machine, the reader's kind attention is directed to U.S. Pat. No. 4,417,536 issued to Tokyo Juki Industrial Co., Ltd.

In such machines, the presser foot and upper feed dog mechanism may be carried on an extended presser arm that is articulately connected to the machine frame. As is known in the art, this articulate connection includes a support block to which the presser arm is secured at one end. The support block usually includes a vertical pin and a rock shaft permitting vertical displacement of the presser arm and thereby the presser foot. The vertical pin serves as a vertical axis about which the presser arm is horizontally rotated whereby permitting removal of the presser foot from the sewing area to allow operator access to the needle. Because of the stresses placed on this connection, especially on the vertical pin, by the oscillatory motion of the upper feed mechanism, the known articulate connection of the presser arm to the frame has been troublesome and is of constant concern to sewing machine designers.

SUMMARY OF THE INVENTION

The device according to the present invention provides a stable support for a presser arm having an upper feed mechanism arranged thereon without limiting operator access to the sewing area. The presser arm has the presser foot hinged at one end thereof. At its other end, the presser arm is provided with an elongated shaft extending transversely away from the presser arm. The shaft provides a slidable pivot for the presser arm of the machine. That is, the presser arm is pivotable about the longitudinal axis of the shaft whereby permitting vertical displacement of the presser foot. Moreover, the presser arm is sidewise displaceable along the longitudinal axis of the supporting shaft in a direction extending generally parallel with the work supporting surface of the machine. The upper feed mechanism, which is carried by the presser arm, is releasably connected to sewing machine driven mechanism which imparts feed lift and feed advancing motions to the upper feed dog.

At its free end, the elongated shaft is releasably associated with operator controlled means for rocking the shaft about its axis. The rocking motion of the shaft is, ultimately, translated into vertical displacement of the presser foot. By the present construction, a stable connection for the presser arm is provided without limiting operator access to the sewing area of the machine.

It is, therefore, a primary object of this invention to provide an overedge sewing machine presser device having interconnected thereon a feed dog that moves in four directions above the throat plate of the machine and wherein the presser arm is mounted to facilitate needle servicing.

Another object of this invention is the provision of an overedge sewing machine presser device including means for slidably and pivotally mounting the presser arm for sidewise movement away from the sewing area or zone.

Still another object of this invention is the provision of a top feed mechanism which is interconnected with the presser arm of the machine and is sidewise displaceable therewith as a modular assemblage.

BRIEF DESCRIPTION OF THE DRAWINGS

Having in mind the above objects and other attendant advantages that would be evident from an understanding of this disclosure, the invention comprises the devices, combination, and arrangement of parts as illustrated in the presently preferred form of the invention which is hereinafter set forth in detail to enable those skilled in the art to readily understand the function, operation, construction, and advantages of same when read in conjunction with the accompanying drawings in which.

DETAILED DESCRIPTION OF THE PRESENT INVENTION

Figure 1:
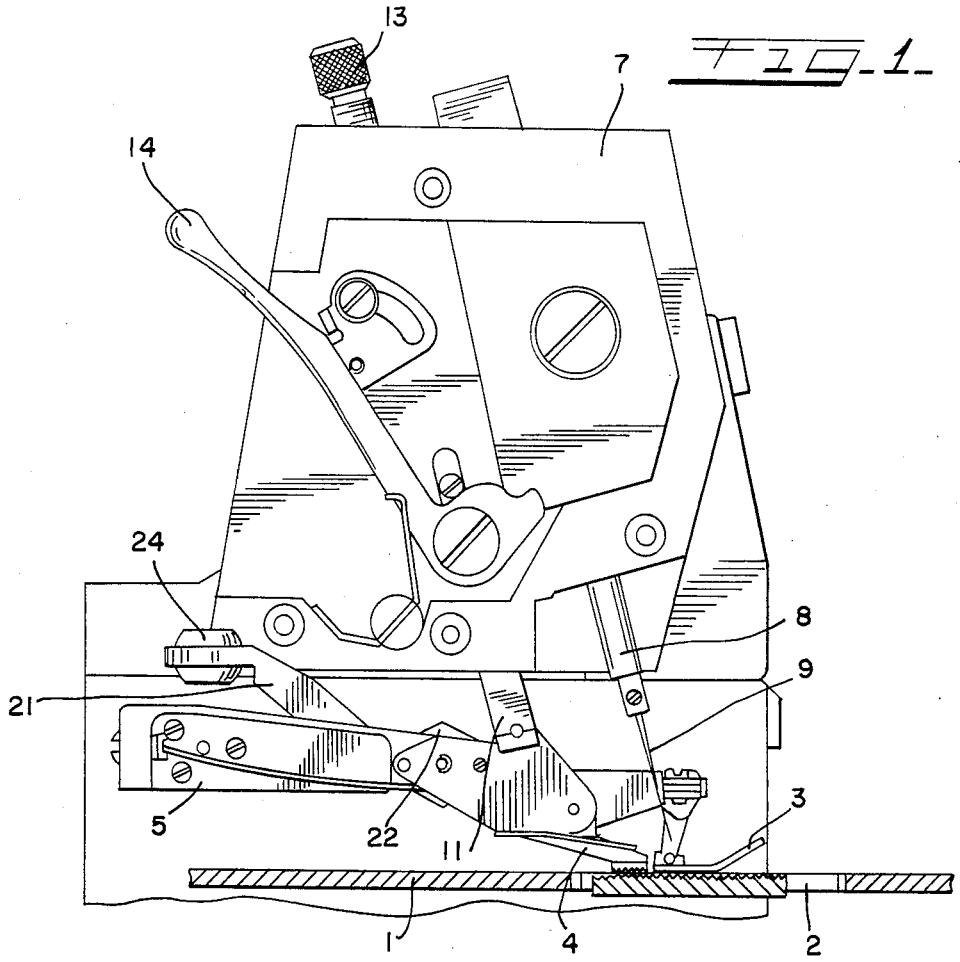
FIG. 1 is a side elevational view of an overedge sewing machine incorporating the present invention.

Referring now to the drawings, wherein like reference numerals indicate like parts throughout the several views, in FIG. 1 there is schematically illustrated a high speed overedge industrial sewing machine of which only a portion is shown. Should the reader be interested in detailed mechanisms of such a machine, their kind attention is directed to U.S. Pat. No. 2,704,042 issued in the named in Ned. L. Wallenberg, et al on Mar. 15, 1969; the full disclosure of which is incorporated herein by reference. Suffice it to say, the sewing machine is provided with a frame having a sewing head 7 overhanging a work supporting surface 1 including a throat plate 2. The machine is further provided with a drop feed mechanism (not shown) including a lower feed dog. The lower feed dog is operative through apertures in the throat plate for engaging the workpiece underface to intermittently advance same over the work supporting surface and along a predetermined feed path. Such a feed mechanism is well known in the art and need not be described further at this time. Within the head 7, and mounted for endwise reciprocation, is a needle bar 8 supporting a needle 9 at its lower or distal end; the needle means defining a sewing area or zone. The needle means cooperate in a well known manner, with conventional loop taker means (not shown) also mounted within the machine frame for forming stitches in a workpiece.

The machine is further provided with a resiliently biased presser mechanism. The presser mechanism serves to hold the work being sewn against the upper surface of the throat plate and in engagement with the lower feed dog. The presser mechanism includes an apertured presser foot 3 hinged at the free end of a presser or support arm 5. The presser arm is articulately connected at its other end to the frame of the machine. A presser bar assembly is reciprocally mounted in the sewing head 7 of the machine for generally vertical movement. At its lower end, the presser bar is provided with a shoe 11 which engages the support arm 5 intermediate the ends thereof. A presser spring operatively presses downward against the shoe to apply downward force on the presser arm 5 thereby urging the presser foot 3 toward the work support. The downward force of the spring exerted on the presser bar may be regulated by an adjusting screw 13 threaded into the sewing machine head 7. An operator actuated presser foot lifting mechanism which includes a presser spring lift lever 14 is articulately mounted to the machine frame and arranged in a well known manner for cooperation with an extension on the presser bar. When operated, the camming action of the lever 14 raises the shoe 11 from engagement with the presser arm 5 whereby relieving the pressure on the presser foot 3.

Figure 3:
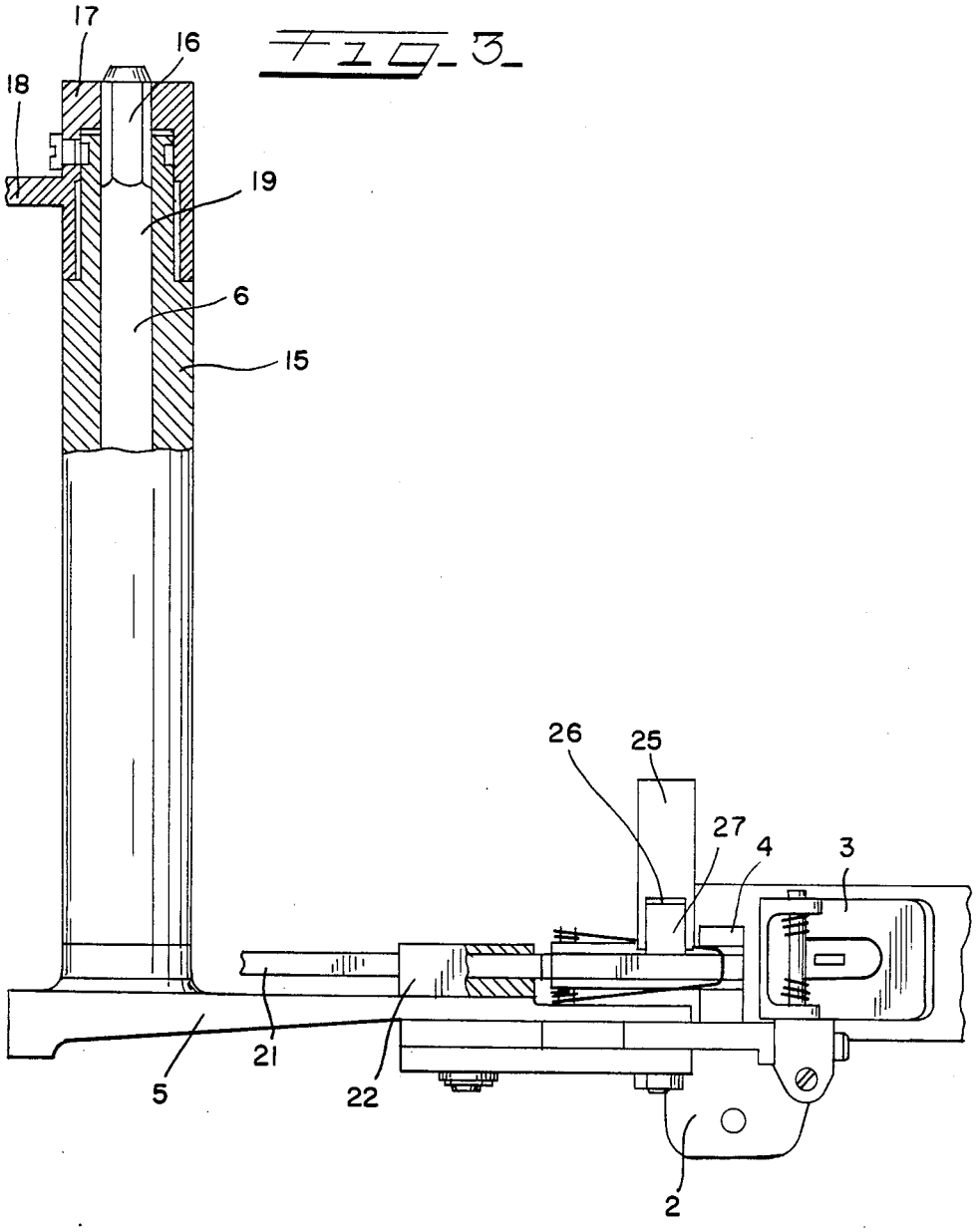
FIG. 3 is a top plan view, partially in section, of the present invention.

Unlike other machines, the presser arm 5 of the present invention is arranged on the machine frame in a unique cantilevered fashion. As best seen in FIG. 3, the presser arm or support 5 is fashioned at its rear extremity with an elongated shaft 6 which provides a slidable pivot for the presser arm 5. In the embodiment shown, the shaft 6 is rigidly secured to the presser arm 5. It is within the spirit and scope of the present invention, however, that the presser arm be shiftably arranged relative to the shaft. That is, other suitable means for slidably connecting the shaft 6 and presser arm 5 to allow for sidewise displacement of the arm are conceivable. The preferred form of the invention has the shaft 6 extending substantially perpendicular or transverse from the arm 5 in a direction extending generally parallel with the work supporting surface 1 of the machine. The shaft 6 is telescopically received for endwise and pivotal movement in bearing means 15 provided on or as a part of the machine frame. As its free end, the shaft 6 is releasably associated with operator controlled actuating means including a crank arm 18. By this construction, rocking movement of the crank arm 18 results in rotary movement of the shaft 6 and, ultimately, vertical displacement of the presser foot 3. In the presently preferred embodiment, such actuating means include an aperture end cap 17 having said crank arm 18 radially extending therefrom. The end cap 17 is revolubly supported on suitable bearing means 19 provided at the distal end of bearing or support means 15. At its free end 16, the shaft is formed as a tapered polygon. A congruent aperture is provided in the end cap 17 so as to provide a releasable connection with the shaft. As a skilled artesian may readily appreciate, the operative association of the free end 16 of shaft 6 and the operator controlled actuating means is a function of the axial displacement of the shaft 6 relative to the actuating means.

Figure 2:
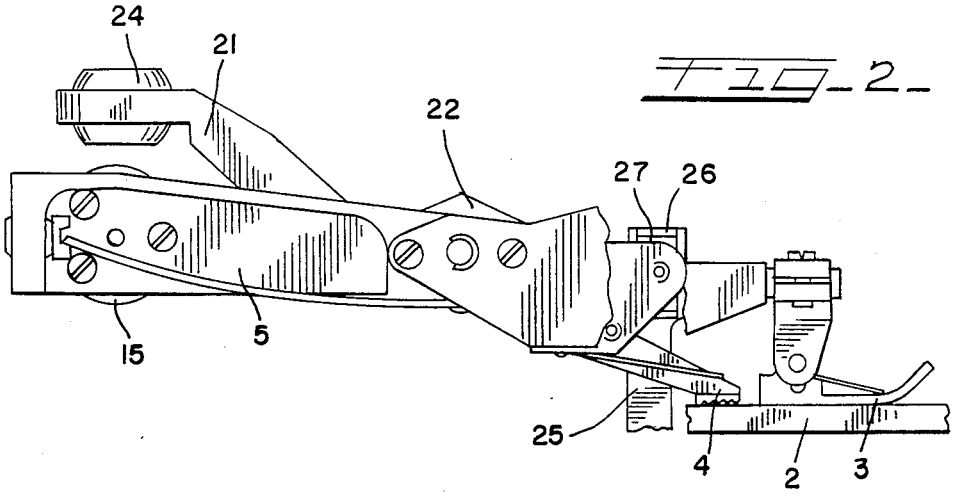
FIG. 2 is an enlarged side elevational view of the present invention.

With only the underside of the workpiece being advanced by the lower feed mechanism, relative slippage between layers of material can, and often does, occur. This situation is corrected by the upper feed mechanism means now to be described. As best seen in FIGS. 1 and 2, the upper or top feed mechanism of the present invention includes an upper feed dog 4. The upper feed dog 4 is carried by the support arm 5 and is positively driven above the work supporting surface of the machine to concommitantly advance the workpiece along the predetermined feed path. In the embodiment having the foregoing construction, the upper feed dog 4 moves in four directions with an opposite phase in its vertical movement to that of the vertical movement of the lower feed dog. The upper feed dog is driven with substantially similar horizontal movements to that of the lower feed dog for effecting an even feeding of the fabric or workpiece plies. Oscillatory means are provided for moving the upper feed dog in four directions. The oscillatory means include a lever or support arm 21 having the upper feed dog carried at one end thereof. The support arm 21 is journaled or mounted for endwise and pivotal movement in a guide block 22 (FIG. 3) carried intermediate the ends of the presser arm 5. The lever means or support arm 21 is operatively connected to mechanism means driven by the sewing machine for imparting feed lift and advancing motions to the upper feed dog. The mechanism means includes first operative means 24 driven by the sewing machine for oscillating the lever 21 in a manner whereby imparting vertical lift movements to the upper feed dog and second operative means 25 driven by the sewing machine for oscillating the lever 21 in a manner whereby imparting horizontal feed advance and return movements to the upper feed dog.

As best seen in FIGS. 1 and 2, the end of the upper feed dog carrier arm 21 opposite the upper feed dog 4 is releasably accomodated within a slotted groove provided on a driving arm of the first operative means. As seen in FIGS. 2 and 3, the lever 21 is also releasably connected to a driving member of the second operative means. In the preferred embodiment, the lever's releasable connection with the second operative means is effected by a pin and slot arrangement. That is, a pin 27 carried by the arm 21 is slidably accomodated in a slot or groove 26 provided on the driving member of the second operative means.

An exemplary operative procedure according to the present invention will now be described. When the operator finds it necessary to raise the presser foot, the crank arm 18 is turned by the operator. As a result of the operative association of the operator actuating means and the shaft 6, the rocking movement of the crank arm 18 is transferred into rotary or pivotal motion of the shaft 6 about its longitudinal axis. This pivotal motion results in a turning motion of the presser arm 5 about the axis of shaft 6 and, ultimately, vertical displacement of the presser foot 3.

In order to exchange the needle, thread the needle or otherwise have servicable access to the sewing area or zone, the needle is first moved to an elevated position. The presser release arm 14 is then manipulated to remove the shoe 11 from engagement with the presser arm 5. Thereafter, the presser arm 5 together with the presser foot 3 and the mechanism comprising the upper feed device may be moved sidewise from the stitch forming area in a direction generally transverse to the feed path and along a path extending substantially parallel with the work supporting surface of the machine. The above mentioned releasable connections established between the lever 21 and the first and second operative drive means permit the sidewise shifting of the arm 5 along with the lever 21 and other associated top feed means as a modular assemblage. The presser arm, the upper feed device, and presser foot may be conjointly moved sufficiently to allow access to the sewing area or the assemblage may be completely removed from association with the machine. The servicing of the needle may then be effective with ease.

After the sewing area has been serviced, the shaft 6 may be slidably returned in the direction opposed to that described above. Because the free end 16 of the shaft 6 is tapered, its introduction to the apertured cap 17 of the operator actuated means is easily effected. Thereafter, the presser release lever 14 is manipulated to lower the shoe 11 into pressing engagement with the presser arm 5. As a result of the above, the presser foot and upper feed dog 4 are returned to their operative position thereby enabling the workpieces to feed through the stitch forming area of the machine.

Thus there has been provided an enabling disclosure of a Upper Feed Mechanism for Sewing Machines which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described our invention, what we claim is:

1. A top feed mechanism for use with a drop feed sewing machine having a frame, reciprocal needle means defining a sewing zone, a lower feed dog operative through a throat plate to engage the underface of a workpiece to advance same along a feed path, said top feed mechanism comprising:

a support member having a presser foot arranged at one end thereof;

an upper feed dog operatively carried by said support member and driven in four directions above an upper surface of the throat plate for concommitantly feeding the workpiece along the feed path;

wherein said support member is supported at its other end about a shaft extending in a direction substantially parallel to the work supporting surface of the machine and slidably arranged relative to the frame such that the upper feed dog can be moved sideways away from the sewing zone; and actuating means for pivoting said support member about the axis of said shaft whereby vertically displacing said presser foot, said shaft being releasably connected to said actuating means.

2. A top feed mechanism for use with a drop feed sewing machine having a frame, reciprocal needle means defining a sewing zone, a lower feed dog operative through a throat plate to engage the underface of a workpiece to advance same along a feed path, said top feed mechanism comprising:

a support member having a presser foot arranged at one end thereof;

an upper feed dog operatively carried by said support member and driven in four directions above an upper surface of the throat plate for concommitantly feeding the workpiece along the feed path;

wherein said support member is supported at its other end about a shaft extending in a direction substantially parallel to the work supporting surface of the machine and slidably arranged relative to the frame such that the upper feed dog can be moved sideways away from the sewing zone; and actuating means for pivoting said support member about the axis of said shaft whereby vertically displacing said presser foot, said shaft being shiftably supported for movement toward and away from said actuating means.

3. A top feed mechanism for use with a drop feed sewing machine having a frame, reciprocal needle means defining a sewing zone, a lower feed dog operative through a throat plate to engage the undersurface of a workpiece to advance same along a feed path, said top feed mechanism comprising:

a support member having a presser foot arranged at one end thereof;

an upper feed dog operatively carried by said support member and driven in four directions above an upper surface of the throat plate for concommitantly feeding the workpiece along the feed path;

wherein said support member is supported at its other end about a shaft extending in a direction substantially parallel to the work supporting surface of the machine and slidably arranged relative to the frame such that the upper feed dog can be moved sideways and from the sewing zone, said shaft being telescopically received within bearing means provided on said frame.

4. The top feed mechanism of claim 3 further including means arranged on said bearing means and releasably connectable to said shaft for selectively pivoting same when turned to thereby lift the presser foot.

5. In combination with a sewing machine having a frame, a work supporting surface and a lower feed dog capable of advancing a workpiece along a predetermined path, a top feed mechanism comprising:

a resiliently biased support member having a presser foot mounted at one end thereof and slidably pivoted at its other end along an axis extending generally parallel with the work supporting surface of the machine, said support member being connected to a shaft providing the slidable pivot therefore and said shaft is telescopically received within bearing means provided on said frame; and an upper feed dog operatively carried on said support member and driven in four directions above the work supporting surface of the machine for concommitantly advancing the workpiece along the predetermined path.

6. In combination with a sewing machine having a frame, a work supporting surface and a lower feed dog, a top feed mechanism comprising:

a presser arm articulately connected to said frame and having a presser foot arranged at the free end thereof, said presser arm includes an elongated shaft transversely extending from said presser arm to provide the articulate connection of said presser arm to said frame;

an upper feed dog carrier arm operatively connected to said presser arm and having an upper feed dog carried thereby; and mechanism means independent of said presser arm driven by said sewing machine and connected to said upper feed dog carrier arm for imparting feed lift and feed advancing movements to said upper feed dog.

7. The top feed mechanism of claim 6 wherein said shaft is slidably pivoted along its longitudinal axis.

8. In a sewing machine having a frame, needle means arranged for reciprocal movement toward and away from a work supporting surface, a presser foot, a lower feed dog for moving a workpiece along a predetermined path, an upper feed mechanism comprising:

a presser arm slidably pivoted relative to said sewing machine frame and having said presser foot arranged at one end thereof, said presser arm includes an elongated shaft transversely extending therefrom and providing the slidable pivot therefor;

an upper feed dog carrier arm operatively mounted on said presser arm and having an upper feed dog carried thereby; and mechanism means independent of said presser arm driven by said sewing machine and connected to said upper feed dog carrier arm for causing movement thereof to impart feed lift and feed advancing movements to said upper feed dog.

9. The invention according to claim 8 wherein said shaft is releasably interconnected with operator controlled means for rotating said shaft whereby vertically displacing said presser foot.

10. The invention according to claim 8 wherein said shaft is shiftably accomodated within a bearing provided on said sewing machine frame.

11. A sewing machine comprising:

a throat plate defining a portion of a work supporting surface;

a pivotal cantilevered arm having a presser foot arranged at its free end, said cantilevered arm being mounted for displacement about and along an axis extending generally parallel to the work supporting surface of the sewing machine;

means for biasing said cantilevered arm and thereby said presser foot toward said throat plate; and workpiece feeding means including an upper feed dog, a support member operatively connected to said cantilevered arm and said upper feed dog, and mechanism means independent of said presser arm driven by said sewing machine for causing movement of said support member in a manner imparting feed movements to said upper feed dog.

12. A sewing machine comprising:

a throat plate defining a portion of a work supporting surface;

a pivotal cantilevered arm having a presser foot arranged at its free end;

means for biasing said cantilevered arm and thereby said presser foot toward said throat plate; and workpiece feeding means including an upper feed dog, a support member operatively connected to said cantilevered arm and said upper feed dog, and mechanism means independent of said presser arm driven by said sewing machine for causing movement of said support member in a manner imparting feed movements of said upper feed dog, said mechanism means includes independently driven first and second operative devices.

13. The invention according to claim 12 wherein said support member is shiftably connected to each of said operative devices.

14. In combination with a sewing machine having a frame, reciprocal needle means, a work supporting surface and a lower feed dog, a top feed mechanism means comprising:

a resiliently biased support member having a presser foot mounted at one end thereof and slidably pivoted at its other end along an axis extending generally parallel with the work supporting surface of the machine, said support member includes a shaft providing the slidable pivot therefore, said shaft being telescopically arranged for pivotal and endwise movement along and about its longitudinal axis;

lever means mounted on said support member intermediate the ends thereof;

an upper feed dog carried at one end of said lever means; and means for oscillating said lever means in a manner whereby imparting feed lift and feed advancing motions to said upper feed dog.

15. In combination with a sewing machine having a frame, reciprocal needle means, a work supporting surface and a lower feed dog, a top feed mechanism means comprising:

a resiliently biased support member having a presser foot mounted at one end thereof and slidably pivoted at its other end along an axis extending generally parallel with the work supporting surface of the machine, said support member includes a shaft providing the slidable pivot therefor;

lever means mounted on said support member intermediate the ends thereof;

an upper feed dog carried at one end of said lever means;

means for oscillating said lever means in a manner whereby imparting feed lift and feed advancing motions to said upper feed dog; and operator controlled means for selectively rotating said shaft whereby vertically displacing said presser foot.

16. The invention according to claim 15 wherein said shaft is releasably interconnected with said operator controlled means such that the shaft may be selectively disconnected from said operator controlled means as a result of axial displacement of said shaft.

17. In combination with a sewing machine having a frame, reciprocal needle means, a work supporting surface and a lower feed dog, a top feed mechanism means comprising:

a resiliently biased support member having a presser foot mounted at one end thereof and slidably pivoted at its other end along an axis extending generally parallel with the work supporting surface of the machine;

lever means mounted on said support member intermediate the ends thereof;

an upper feed dog carried at one end of said lever means; and means independent of said presser arm for oscillating said lever means in a manner whereby imparting feed lift and feed advancing motions to said upper feed dog, said oscillating means includes first operative means for imparting lift movements to said upper feed dog and second operative means for imparting feed advancing movements to said upper feed dog, said lever means being releasably interconnected to both said first and second operative means.

* * * * *